US008941574B2

(12) United States Patent
Kim et al.

(10) Patent No.: US 8,941,574 B2
(45) Date of Patent: Jan. 27, 2015

(54) LIQUID CRYSTAL DISPLAY AND METHOD OF CONTROLLING DOT INVERSION THEREOF

(75) Inventors: Jongwoo Kim, Kyungbuk (KR); Hyuntaek Nam, Daegu (KR); Myungkook Moon, Daegu (KR)

(73) Assignee: LG Display Co., Ltd., Seoul (KR)

( * ) Notice: Subject to any disclaimer, the term of this patent is extended or adjusted under 35 U.S.C. 154(b) by 560 days.

(21) Appl. No.: 12/844,252

(22) Filed: Jul. 27, 2010

(65) Prior Publication Data

US 2011/0037746 A1 Feb. 17, 2011

(30) Foreign Application Priority Data

Aug. 14, 2009 (KR) ..... 10-2009-0075385

(51) Int. Cl.
*G09G 3/36* (2006.01)

(52) U.S. Cl.
CPC ..... *G09G 3/3648* (2013.01); *G09G 3/3688* (2013.01); *G09G 3/3611* (2013.01); *G09G 3/3614* (2013.01); *G09G 2300/0426* (2013.01); *G09G 2300/0452* (2013.01); *G09G 2320/0233* (2013.01)
USPC ..... 345/96

(58) Field of Classification Search
CPC .. G09G 3/3614; G09G 3/3648; G09G 3/3688
USPC ..... 345/96, 87, 211
See application file for complete search history.

(56) References Cited

U.S. PATENT DOCUMENTS

| | | | | |
|---|---|---|---|---|
| 7,688,301 | B2 * | 3/2010 | Lee et al. | 345/96 |
| 2005/0280622 | A1 * | 12/2005 | Lee et al. | 345/96 |
| 2007/0001965 | A1 * | 1/2007 | Lee | 345/96 |
| 2008/0170024 | A1 * | 7/2008 | Song et al. | 345/96 |
| 2009/0002302 | A1 * | 1/2009 | Koo et al. | 345/89 |
| 2009/0021462 | A1 * | 1/2009 | Furihata et al. | 345/89 |

FOREIGN PATENT DOCUMENTS

| | | |
|---|---|---|
| KR | 1020030078786 A | 10/2003 |
| KR | 1020050097032 | 10/2005 |

OTHER PUBLICATIONS

Korean Office Action dated May 7, 2013 issued for Korean Patent Application No. 10-2009-0075385.

* cited by examiner

*Primary Examiner* — Chanh Nguyen
*Assistant Examiner* — John Kirkpatrick
(74) *Attorney, Agent, or Firm* — Morgan, Lewis & Bockius LLP

(57) ABSTRACT

A liquid crystal display includes: a liquid crystal display panel including a plurality of data lines and a plurality of gate lines crossing each other; a first source drive IC for outputting a data voltage to the data lines and inverting the polarity of the data voltage in response to a first polarity control signal; a second source drive IC for outputting the data voltage to the data lines and inverting the polarity of the data voltage in response to a second polarity control signal; and a timing controller for generating the first and second polarity control signals in the same phase when the source drive ICs output data voltages whose polarity is inverted by horizontal 1-dot inversion and generating the first and second polarity control signals in the opposite phase to each other when the source drive ICs output data voltages whose polarity is inverted by horizontal 2-dot inversion.

5 Claims, 12 Drawing Sheets

LIQUID CRYSTAL DISPLAY AND METHOD OF CONTROLLING DOT INVERSION THEREOF

This application claims the benefit of Korean Patent Application No. 10-2009-0075385 filed on Aug. 14, 2009, the entire contents of which is incorporated herein by reference for all purposes as if fully set forth herein.

BACKGROUND

1. Field

This document relates to a liquid crystal display and a method of controlling dot inversion thereof.

2. Related Art

An active matrix type liquid crystal display displays moving images using thin film transistors (hereinafter, referred to as "TFTs") as switching elements. In comparison with a cathode ray tube (CRT), the liquid crystal display can have a smaller size. Thus, the liquid crystal display is used as displays in portable information devices, office equipment, computers, televisions, etc., and hence is fast replacing the cathode ray tube.

Liquid crystal cells of the liquid crystal display a picture image by changing transmittance by a potential difference between a data voltage supplied to a pixel electrode and a common voltage supplied to a common electrode. The liquid crystal display is generally driven by an inversion scheme of periodically inverting the polarity of the data voltage applied to the liquid crystal cell in order to prevent deterioration of the liquid crystal. When the liquid crystal display is driven by an inversion scheme, the liquid crystal display may have a low picture quality according to a correlation between the polarities of data voltages charged in the liquid crystal cells and the data voltages. This is because the polarity of data voltages charged in the liquid crystal cells are not balanced between the positive and negative polarities but either of the positive and negative polarities becomes dominant, and hence the common voltage applied to the common electrode is shifted. Once the common voltage is shifted, the reference potential of the liquid crystal cells is shifted, and this causes a viewer to feel flicker or smear on an image displayed on the liquid crystal display.

The polarity of the data voltages is determined by a polarity control signal POL output from a timing controller. Each source drive IC outputs a positive data voltage or negative data voltage in response to the polarity control signal POL. The vertical polarity of the data voltages output continuously through output channels of the source drive IC is determined according to the polarity control signal POL. The horizontal polarity of the data voltages output simultaneously from output channels of the source drive IC is determined by the polarity control signal POL. The horizontal polarity inversion cycle of the data voltages is determined according to a logic value of a voltage applied to an option terminal H_2DOT of each of the source drive ICs.

FIG. 1 is a view illustrating horizontal 1-dot inversion.

Referring to FIG. 1, the timing controller TCON commonly supplies a polarity control signal POL to source drive ICs, and each of the source drive ICs SDIC1 to SDIC3 supplies data voltages whose polarities are converted by horizontal 1-dot inversion to data lines of a liquid crystal display panel in response to the polarity control signal POL. In the horizontal 1-dot inversion, the polarities of odd-numbered data voltages supplied to odd-numbered data lines and the polarities of even-numbered data voltages supplied to even-numbered data lines are opposite to each other. Accordingly, in the horizontal 1-dot inversion, the polarities of data voltages simultaneously output from the source drive ICs SDIC1 to SDIC3 are inverted for each 1 dot (or for each liquid crystal cell). If the first logic value of the polarity control signal POL is high, the source drive ICs SDIC1 to SDIC3 output the odd-numbered data voltages of the first horizontal display line LINE#1 as positive data voltages (+) and the even-numbered data voltages of the first horizontal display line LINE#1 as negative data voltages (−) as shown in FIG. 1. In the next frame period, if the first logic value of the polarity control signal POL is inverted to low, the source drive ICs SDIC1 to SDIC3 output the odd-numbered data voltages of the first horizontal display line LINE#1 as negative data voltages (−) and the even-numbered data voltages of the first horizontal display line LINE#1 as positive data voltages (+).

FIG. 2 is a view illustrating horizontal 2-dot inversion.

Referring to FIG. 2, the timing controller TCON commonly supplies a polarity control signal POL to the source drive ICs, and each of the source drive ICs SDIC1 to SDIC3 supplies data voltages whose polarities are converted by horizontal 2-dot inversion to data lines of the liquid crystal display panel in response to the polarity control signal POL. In the horizontal 2-dot inversion, the polarities of data voltages supplied to (4i+1)-th and (4i+4)-th data lines (i is a positive integer) and the polarities of data voltages supplied to (4i+2)-th and (4i+3)-th data lines are opposite to each other. Accordingly, in the horizontal 2-dot inversion, the polarities of data voltages simultaneously output from the source drive ICs SDIC1 to SDIC3 are inverted every 2 dots. If the first logic value of the polarity control signal POL is high, the source drive ICs SDIC1 to SDIC3 output the (4i+1)-th and (4i+4)-th data voltages of the first horizontal display line LINE#1 as positive data voltages (+) and the (4i+2)-th and (4i+3)-th data lines of the first horizontal display line LINE#1 as negative data voltages (−) as shown in FIG. 2. In the next frame period, if the first logic value of the polarity control signal POL is inverted to low, the source drive ICs SDIC1 to SDIC3 output the (4i+1)-th and (4i+4)-th data voltages of the first horizontal display line LINE#1 as negative data voltages (−) and the (4i+2)-th and (4i+3)-th of the first horizontal display line LINE#1 as positive data voltages (+).

Each of the source drive ICs SDIC1 to SDIC3 receive the same polarity control signal as in FIGS. 1 and 2 and inverts the polarity of data voltages. However, in the horizontal 2-dot inversion, in the case that the remainder left after dividing the number of output channels of the source drive IC by 4 is not zero, for example, the number of output channels of the source drive IC is 630 or 690, the horizontal polarity of the data voltages is inverted by vertical 1-dot inversion at the boundaries between the source drive ICs as indicated by dotted circles in FIG. 2. In this case, a luminance difference appears in a pixel array section driven by the horizontal 2-dot, inversion and a pixel array section between the source drive ICs driven by the horizontal 1-dot inversion. Accordingly, in the horizontal 2-dot inversion driving scheme as shown in FIG. 2, a boundary noise is observed between the source drive ICs. Such a boundary noise becomes severe when an FRC correction value is added to data in the process of applying frame rate control (FRC) to increase picture quality.

The present inventor proposed, in Koran Patent Application No. 10-2008-0032638 filed on Apr. 8, 2008, a technique for minimizing common voltage shift in any weak pattern and minimizing flickering, color distortion, etc. by analyzing a weak pattern in an input image and adaptively selecting a horizontal 1-dot inversion scheme or a horizontal 2-dot inversion scheme according to the type of the weak pattern to drive a liquid crystal display panel. To further increase the effect of display quality improvement of this technique, a boundary noise that may appear in the horizontal 2-dot inversion has to be eliminated.

SUMMARY

An aspect of this document is to provide a liquid crystal display, which prevents a boundary noise from being seen in horizontal 2-dot inversion, and a method of controlling dot inversion thereof.

In one aspect, a liquid crystal display includes: a liquid crystal display panel including a plurality of data lines and a plurality of gate lines crossing each other; a first source drive IC for outputting a data voltage to the data lines and inverting the polarity of the data voltage in response to a first polarity control signal; a second source drive IC for outputting the data voltage to the data lines and inverting the polarity of the data voltage in response to a second polarity control signal; and a timing controller for generating the first and second polarity control signals in the same phase when the source drive ICs output data voltages whose polarity is inverted by horizontal 1-dot inversion and generating the first and second polarity control signals in the opposite phase to each other when the source drive ICs output data voltages whose polarity is inverted by horizontal 2-dot inversion.

In another aspect, a method of controlling dot inversion of a liquid crystal display includes: generating the first and second polarity control signals in the same phase when source drive ICs output data voltages whose polarity is inverted by horizontal 1-dot inversion; generating the first and second polarity control signals in the opposite phase to each other when the source drive ICs output data voltages whose polarity is inverted by horizontal 2-dot inversion; and inputting the first polarity control signal into the first source drive IC and the second polarity control signal into the second source drive IC.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION

Figure 1:
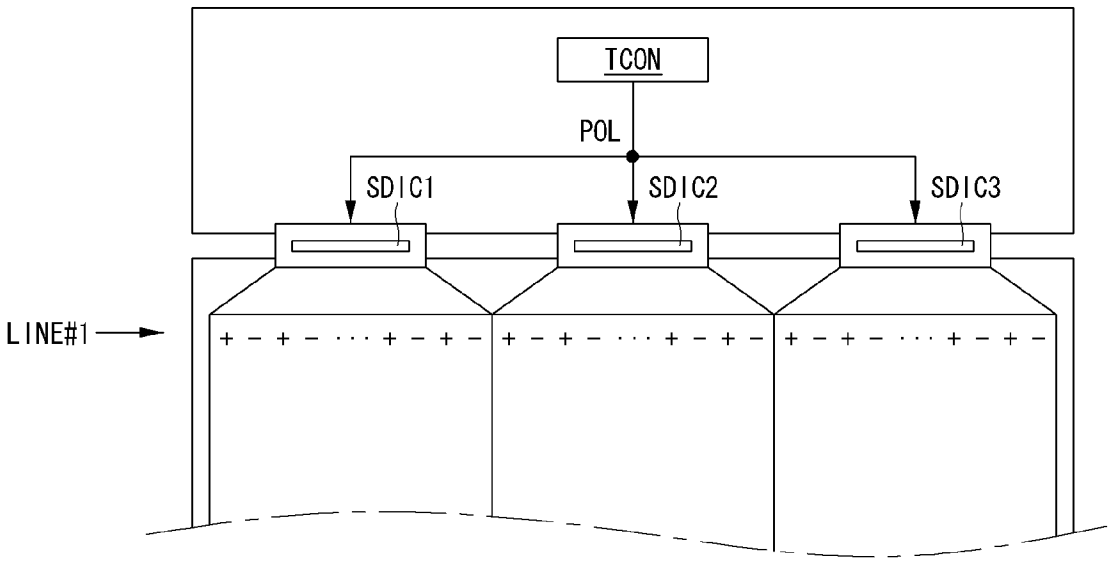
FIG. 1 (RELATED ART)
FIG. 1 is a view illustrating horizontal 1-dot inversion in a conventional liquid crystal display.

Hereinafter, exemplary embodiments of the present invention will be described in detail with reference to the attached drawings. Throughout the specification, the same reference numerals indicate substantially the same components. In connection with description of the present invention hereinafter, if it is considered that description of known functions or constructions related to the present invention may make the subject matter of the present invention unclear, the detailed description thereof will be omitted.

Terms which will be described hereinafter are established taking into consideration easiness of writing the specification into account and may vary according to manufacturer's intention or a usual practice in the related art.

Figure 3:
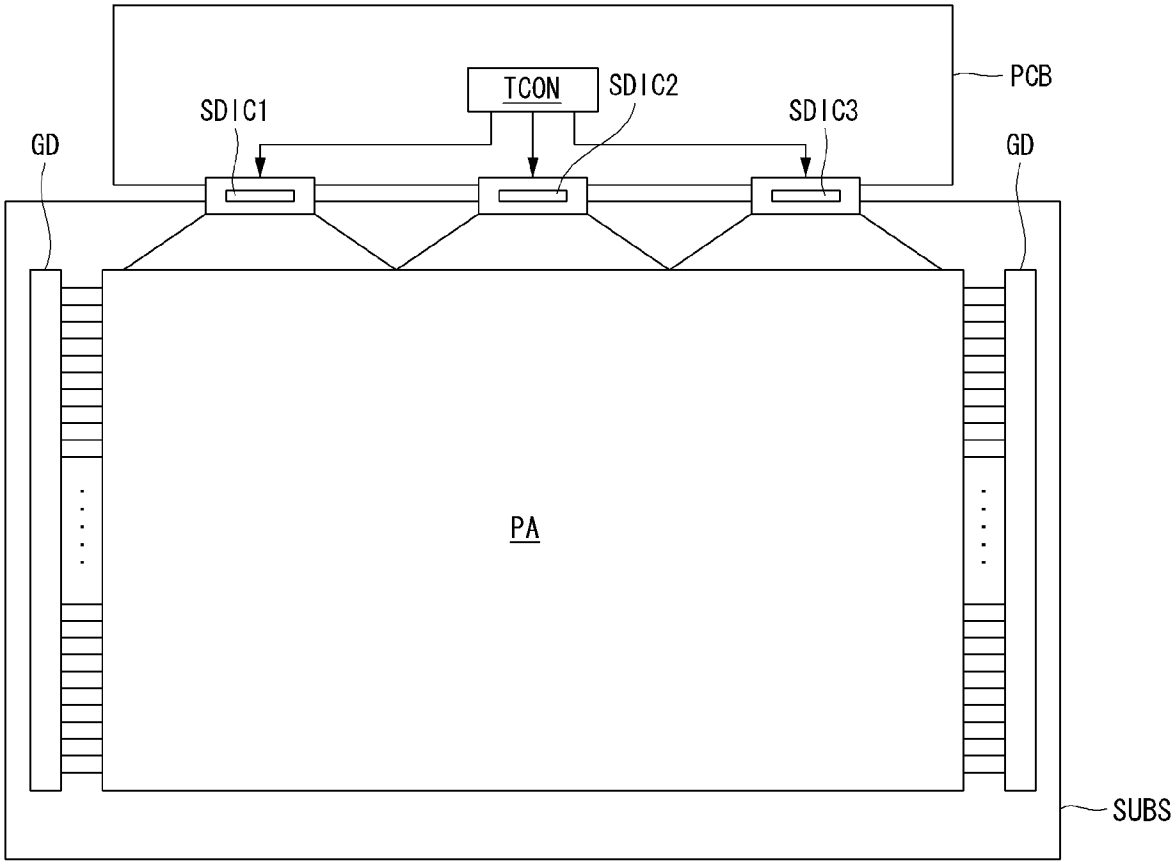
FIG. 3 is a block diagram schematically showing a liquid crystal display according to an exemplary embodiment of the present invention.

FIG. 3 shows a liquid crystal display according to an exemplary embodiment of the present invention.

Referring to FIG. 3, the liquid crystal display according to the exemplary embodiment of the present invention comprises a liquid crystal display panel having a pixel array PA, a plurality of source drive ICs SDIC1 to SDIC3, a gate driving circuit GD, and a timing controller TCON. A backlight unit for uniformly irradiating light to the liquid crystal display panel may be disposed under the liquid crystal display panel.

Figure 4:
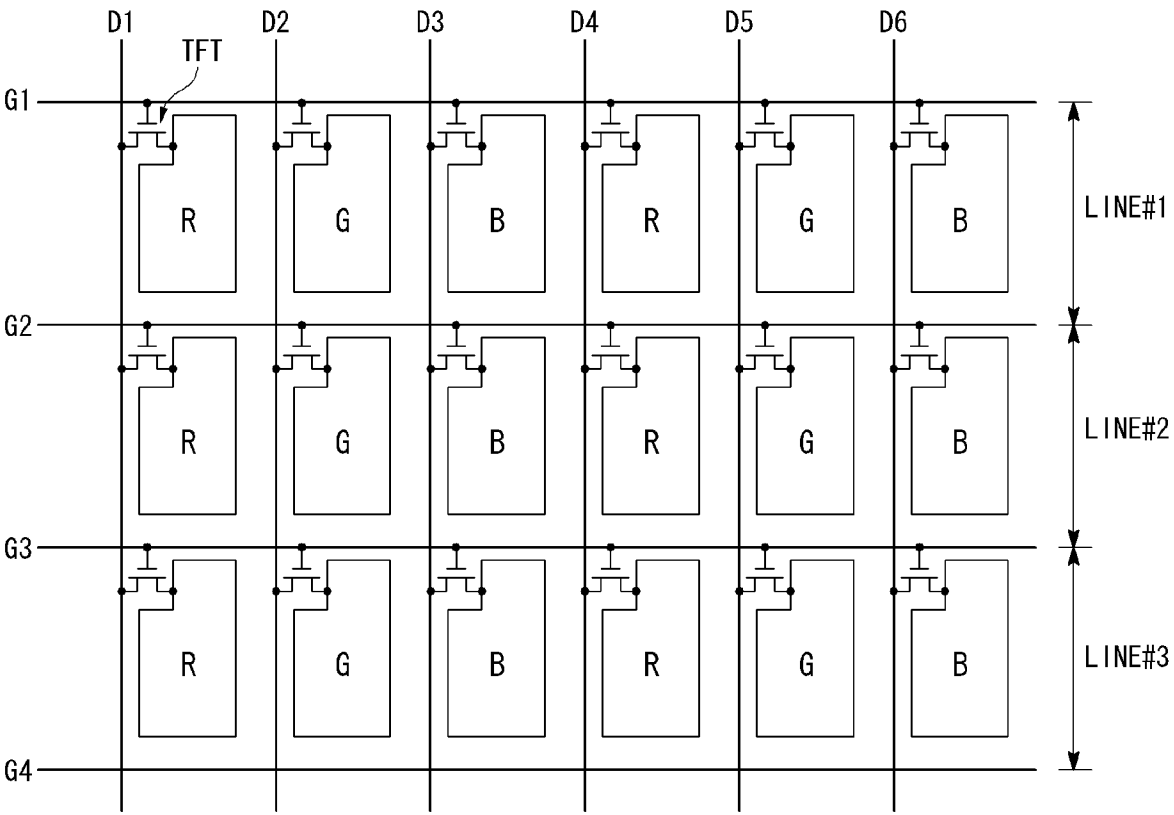
FIGS. 4 to 6 are equivalent circuit diagrams showing in detail various examples of a pixel array shown in FIG. 3.
Figure 5:
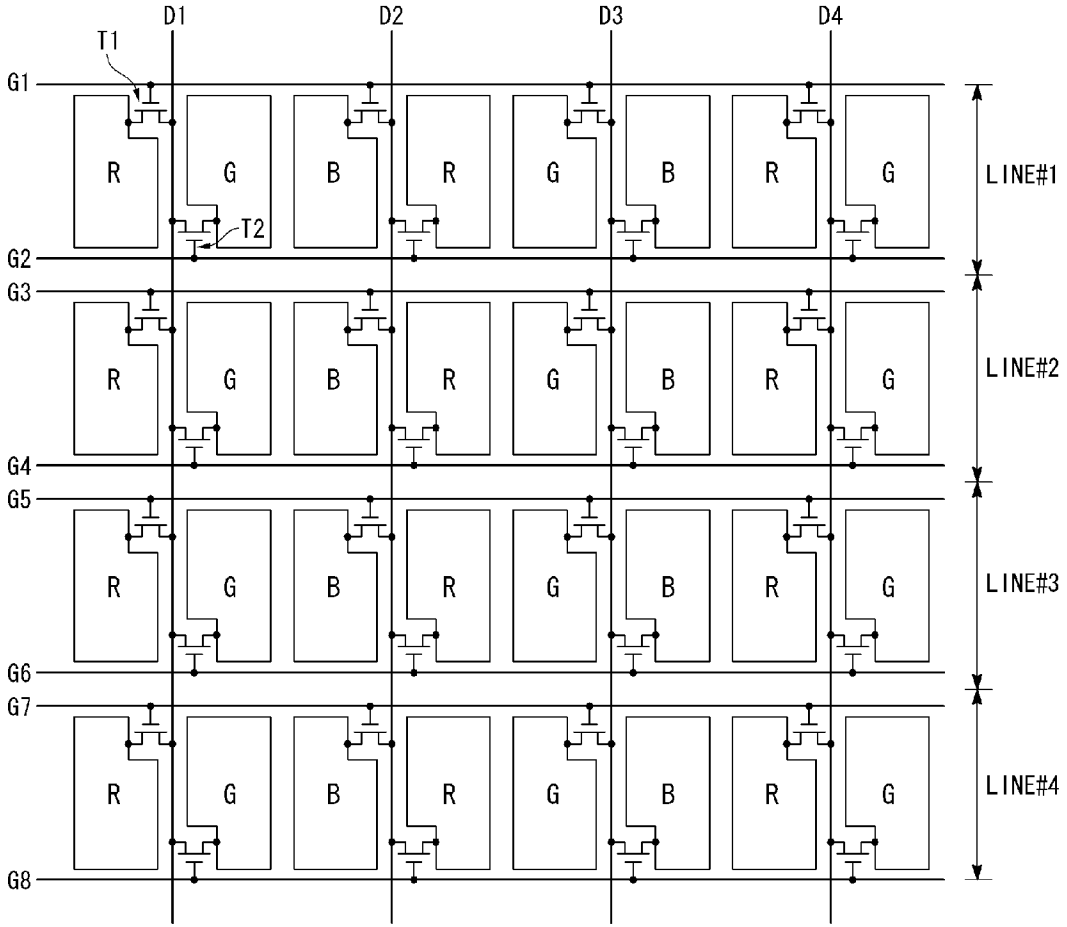
Figure 6:
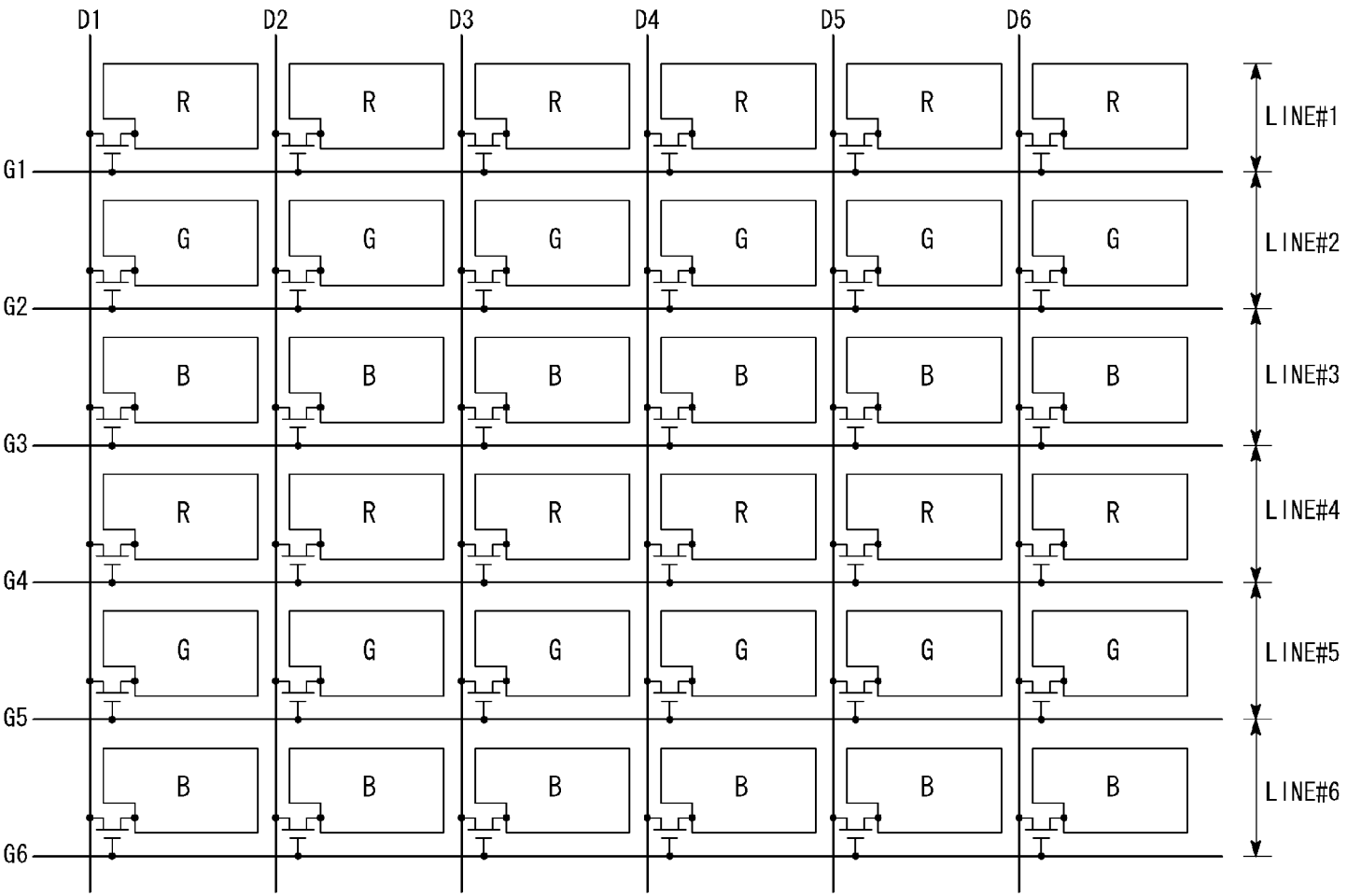

The liquid crystal display panel comprises an upper glass substrate and a lower glass substrate facing each other with a liquid crystal layer interposed therebetween. The pixel array PA of the liquid crystal display panel comprises liquid crystal cells arranged in a matrix form defined by data lines and gate lines, which cross each other, to display video data. The pixel array PA comprises TFTs formed at crossings between the data lines and the gate lines and pixel electrodes connected to the TFTs. The pixel array PA may be modified in various manners as shown in FIGS. 4 to 6. In a pixel array PA of FIG. 5, adjacent liquid crystal cells share one data line, and thus can reduce the number of data lines and source drive ICs as compared to the pixel array of FIG. 4. Each of the liquid crystal cells of the pixel array PA is driven by a voltage difference between the pixel electrode charged with a data voltage through the TFT and a common electrode to which a common voltage is applied, and displays the data of the video data by adjusting the transmission amount of light. A black matrix, color filters, and a common electrode are formed on the upper glass substrate of the liquid crystal display panel. Polarizing plates are respectively attached to the upper and lower glass substrates of the liquid crystal display panel. Alignment layers for setting a pre-tilt angle of the liquid crystal are respectively formed on the upper and lower glass substrates of the liquid crystal display panel.

The common electrode is formed on the upper glass substrate in a vertical electric field driving method such as a twisted nematic (TN) mode and a vertical alignment (VA) mode. On the other hand, the common electrode is formed on the lower glass substrate together with the pixel electrode in a horizontal electric field driving method such as an in plane switching (IPS) mode and a fringe field switching (FFS) mode.

The liquid crystal display panel applicable in the present invention may be implemented in any liquid crystal mode, as well as the TN mode, VA mode, IPS mode, and FFS mode. Moreover, the liquid crystal display of the present invention may be implemented in any form including a transmissive liquid crystal display, a transflective liquid crystal display, and a reflective liquid crystal display. The transmissive liquid crystal display and the transflective liquid crystal display require a backlight unit. The backlight unit may be a direct type backlight unit or an edge type backlight unit.

Output channels of each of the source drive ICs SDIC1 to SDIC3 are connected to the data lines of the pixel array PA at 1:1. The source drive ICs SDIC1 to SDIC3 sample and latch digital video data input from the timing controller TCON to convert the digital video data of a serial data transmission scheme into digital video data of a parallel data transmission scheme. The source drive ICs SDIC1 to SDIC3 receive positive/negative gamma compensation voltages. The source drive ICs SDIC1 to SDIC3 convert the digital video data into positive/negative analog video data voltages in accordance with a polarity control signal POL based on the positive/negative gamma compensation voltages. Then, the source drive ICs SDIC1 to SDIC3 output the positive/negative data voltages to the data lines of the pixel array PA in response to a source output enable signal SOE. The source drive ICs SDIC1 to SDIC3 can be adhered on the lower glass substrate of the liquid crystal display panel by a chip on glass (COG) process, or can be bonded to the lower glass substrate of the liquid crystal display panel in a tape carrier package (TCP) form by a tape automated bonding (TAB) process.

The gate driving circuit GD sequentially supplies gate pulses (or scan pulses) to the gate lines of the pixel array in response to gate timing control signals from the timing controller TCON. The gate driving circuit GD may be mounted on a TCP and bonded to the lower glass substrate of the liquid crystal display panel by a TAB process, or may be formed directly on the lower glass substrate, simultaneously with the pixel array PA, by a gate in panel (GIP) process. The gate driving circuit GD may be disposed at both sides of the pixel array PA or at one side of the pixel array PA.

The timing controller TCON supplies digital video data, which is input from an external system board through an interface, such as a low voltage differential signaling (LVDS) interface, a transition minimized differential signaling (TMDS) interface, etc, to the source drive ICs SDIC1 to SDIC3 through a mini LVDS interface. Moreover, the timing controller TCON receives timing signals, such as a vertical synchronization signal Vsync, a horizontal synchronization signal Hsync, a data enable signal DE, a dot clock signal CLK, etc through an LVDS interface or a TMDS interface. The timing controller TCON generates a data timing control signal for controlling the operation timing of the source drive ICs and a gate timing control signal for controlling the operation timing of the gate driving circuit GD by using the timing signals Vsync, Hsync, DE, and CLK. The timing controller TCON is able to multiply the frequency of the gate timing control signal and the frequency of the data timing control signal by a frame frequency of (60×i) Hz (i is a positive integer of 2 or greater) so that the digital video data input at a frame frequency of 60 Hz can be reproduced at a frame frequency of (60×i) Hz by the pixel array PA of the liquid crystal display panel. The timing controller TCON is mounted on a printed circuited board (PCB).

The timing controller TCON can reduce the number of bits of input digital video data RGB supplied to the source drive ICs SDIC1 to SDIC3 by expanding gray levels by using frame rate control (FRC). To this end, the timing controller TCON generates j-bit digital video data (j is a natural number less than i) by adding an FRC correction value to i-bit input data video data (i is a natural number of 6 or greater), and supplies the j-bit digital video data to the source drive ICs SDIC1 to SDIC3 through the mini LVDS interface.

The data timing control signal comprises a source start pulse SSP, a source sampling clock SSC, a source output enable signal SOE, a polarity control signal POL, etc. The source sampling clock SSC is a clock signal for controlling a data sampling operation of the source drive ICs SDIC1 to SDIC3 based on a rising or falling edge. The source start pulse SSP controls a data sampling start point of the source drive ICs SDIC1 to SDIC3. If the data and the data timing control signal are transmitted between the timing controller TCON and the source drive ICs SDIC1 to SDIC3 through the mini LVDS interface, the source start pulse SSP and the source sampling clock SSC can be omitted. The polarity control signal POL is respectively input into each of the source drive ICs SDIC1 to SDIC3 and controls the polarity of the data voltages output from the source drive ICs SDIC1 to SDIC3. The logic of the polarity control signal POL is inverted every N horizontal period (N is a positive integer). The source output enable signal SOE controls an output timing of the source drive ICs SDIC1 to SDIC3. The data timing control signal may further comprise a horizontal polarity control signal HINV. The horizontal polarity control signal HINV is commonly input into an option terminal H_2DOT of each of the source drive ICs SDIC1 to SDIC3 and controls the horizontal polarity pattern of the data voltages output simultaneously from the source drive ICs SDIC1 to SDIC3. If a logic value of the horizontal polarity control signal HINV is high (H), the source drive ICs SDIC1 to SDIC3 invert the polarity of the simultaneously output data voltages by horizontal 2-dot inversion. If a logic value of the horizontal polarity control signal HINV is low (L), the source drive ICs SDIC1 to SDIC3 invert the polarity of the simultaneously output data voltages by horizontal 1-dot inversion. The timing controller TCON can detect an input image of a weak pattern and adaptively vary the logic inversion cycle of each of the polarity control signals POL according to the type of the weak pattern, and, moreover, can control the logic value of the horizontal polarity control signal HINV differently according to the type of the weak pattern.

The gate timing control signal comprises a gate start pulse GSP, a gate shift clock GSC, a gate output enable signal GOE, etc. The gate start pulse GSP controls the timing of a first gate pulse. The gate shift clock GSC is a clock signal for shifting the gate start pulse GSP. The gate output enable signal GOE controls an output timing of the gate driving circuit GD.

FIGS. 4 to 6 are equivalent circuit diagrams showing various examples of a pixel array PA.

The pixel array PA of FIG. 4 is a pixel array applied to most of liquid crystal displays, in which data lines D1 to D6 and gate lines G1 to G4 cross each other. In this pixel array PA, liquid crystal cells of red subpixels (R), liquid crystal cells of green subpixels (G), and liquid crystal cells of blue subpixels (B) are respectively arranged along a column direction. Each of the TFTs supplies a data voltage from the data lines D1 to D6 to the pixel electrode of the liquid crystal cell disposed to the left (or right) of the data lines D1 to D6 in response to a gate pulse from the gate lines G1 to G4. In the pixel array shown in FIG. 4, 1 pixel comprises a red subpixel (R), a green subpixel (G), and a blue subpixel (B) that are adjacent in a row direction (or line direction) crossing the column direction. When the resolution of the pixel array shown in FIG. 4 is m×n, m×3 (where 3 is RGB) data lines and n gate lines are required. Gate pulses for one horizontal period synchronized with data voltages are sequentially supplied to the gate lines of this pixel array.

As for the pixel array PA shown in FIG. 5, when compared with the pixel array shown in FIG. 4, the number of data lines required at the same resolution Can be reduced to a half, and the number of required source drive ICs can also be reduced to a half. In this pixel array, liquid crystal cells of red subpixels (R), liquid crystal cells of green subpixels (G), and liquid crystal cells of blue subpixels (B) are respectively arranged along a column direction. In the pixel array shown in FIG. 5, 1 pixel comprises a red subpixel (R), a green subpixel (G), and a blue subpixel (B) that are adjacent in a line direction crossing the column direction. The liquid crystal cells adjacent in the left and right direction in the pixel array shown in FIG. 5 are continually charged with data voltages supplied in a time-division manner through the same data lines. A connection relationship of the TFTs will be described by defining the liquid crystal cell and the TFT disposed to the left of the data lines D1 to D4 as the first liquid crystal cell and the first TFT (T1), and the liquid crystal cell and the TFT disposed to the right of the data lines D1 to D4 as the second liquid crystal cell and the second TFT (T2). The first TFT (T1) supplies data voltages from the data lines D1 to D4 to the pixel electrode of the first liquid crystal cell in response to gate pulses from the odd-numbered gate lines G1, G3, G5, and G7. A gate electrode of the first TFT (T1) is connected to the odd-numbered gate lines G1, G3, G5, and G7, and a drain electrode of the first TFT (T1) is connected to the data lines D1 to D4. A source electrode of the first TFT (T1) is connected to the pixel electrode of the first liquid crystal cell. The second TFT (T2) supplies data voltages from the data lines D1 to D4 to the pixel electrode of the second liquid crystal cell in response to gate pulses from the even-numbered gate lines G2, G4, G6, and G8. A gate electrode of the second TFT (T2) is connected to the even-numbered gate lines G2, G4, G6, and G8, and a drain electrode of the second TFT (T2) is connected to the data lines D1 to D4. A source electrode of the second TFT (T2) is connected to the pixel electrode of the second liquid crystal cell. When the resolution of the pixel array shown in FIG. 5 is m×n, {m×3/2} (where 3 is RGB) data lines and 2n gate lines are required. Gate pulses for ½ horizontal period synchronized with data voltages are sequentially supplied to the gate lines of this pixel array PA.

As for the pixel array shown in FIG. 6, when compared with the pixel array PA shown in FIG. 4, the number of data lines required at the same resolution can be reduced to ⅓, and the number of required source drive ICs can be also reduced to ⅓. In this pixel array, liquid crystal cells of red subpixels (R), liquid crystal cells of green subpixels (G), and liquid crystal cells of blue subpixels (B) are respectively arranged along a line direction. In the pixel array shown in FIG. 6, 1 pixel comprises a red subpixel (R), a green subpixel (G), and a blue subpixel (B) that are adjacent in a column direction. Each of the TFTs supplies a data voltage from the data lines D1 to D6 to the pixel electrode of the liquid crystal cell disposed to the left (or right) of the data lines D1 to D6 in response to a gate pulse from the gate lines G1 to G6. When the resolution of the pixel array PA shown in FIG. 6 is m×n, m data lines and 3n gate lines are required. Gate pulses for ⅓ horizontal period synchronized with data voltages are sequentially supplied to the gate lines of this pixel array PA.

Figure 7:
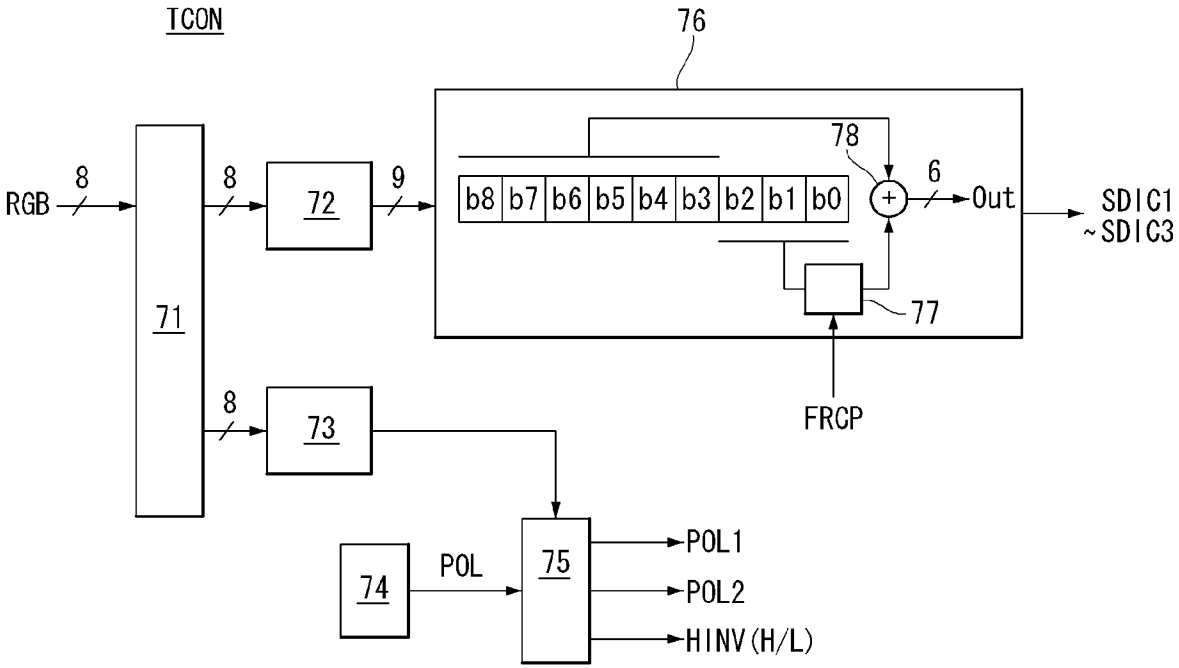
FIG. 7 is a circuit diagram showing in detail a timing controller shown in FIG. 3.

FIG. 7 is a circuit diagram showing the circuit configuration of a data processing part and a polarity control signal processing part of the timing controller ICON.

Referring to FIG. 7, the timing controller TCON comprises an interface receiver 71, a bit expander 72, an FRC processor 76, an image analyzer 73, and a polarity control signal generator 74, and a polarity control signal conversion logic circuit 75.

The interface receiver 71 receives 8-bit digital video data transmitted at an LVDS or TMDS interface standard and supplies it to the bit extender 72 and the image analyzer 73. The bit extender 72 separates the 8-bit digital video data into even-numbered pixel data and odd-numbered pixel data, and extends the data to 9-bit digital video data by appending least significant bits (LSB) to the data.

The FRC processor 76 encodes 3-bit FRC data for generating an intermediate gray level of ⅛ to ⅞ in the LSB 3 bits of the 9-bit data input from the bit extender 72, and adds an FRC correction value '1' or '0' to the MSB 6 bits (b3 to b8) of pixel data assigned by the FRC data. The FRC processor 76 outputs 6-bit data. The 6-bit data is transmitted to the source drive ICs SDIC1 to SDIC3 through a mini LVDS transmitting circuit. The FRC processor 76 comprises an FRC correction value generator 77 and an adder 78. The FRC correction value generator 77 outputs a correction value (1 or 0) assigned to a pre-stored FRC pattern, and the adder 78 adds the correction value of the FRC pattern to the LSB 3 bits of the 9-bit digital video data.

The image analyzer 73 analyzes the input image to detect weak patterns in which white gray scale data and black gray scale data are regularly arranged, and outputs a control signal for controlling the source drive ICs SDIC1 to SDIC3 by the horizontal 2-dot inversion upon receipt of weak pattern data and controlling the source drive ICs by the horizontal 1-dot inversion upon receipt of normal pattern data other than weak pattern data. The image analyzer 73 can employ the image analysis techniques disclosed in Korean Patent Application Nos. 10-2008-0032638 filed on Apr. 8, 2008, 20-2008-0055419 field on Jun. 12, 2008:10-2008-0134694 field on Dec. 26, 2008, and 10-2008-0134147 field on Dec. 26, 2008.

Figure 8:
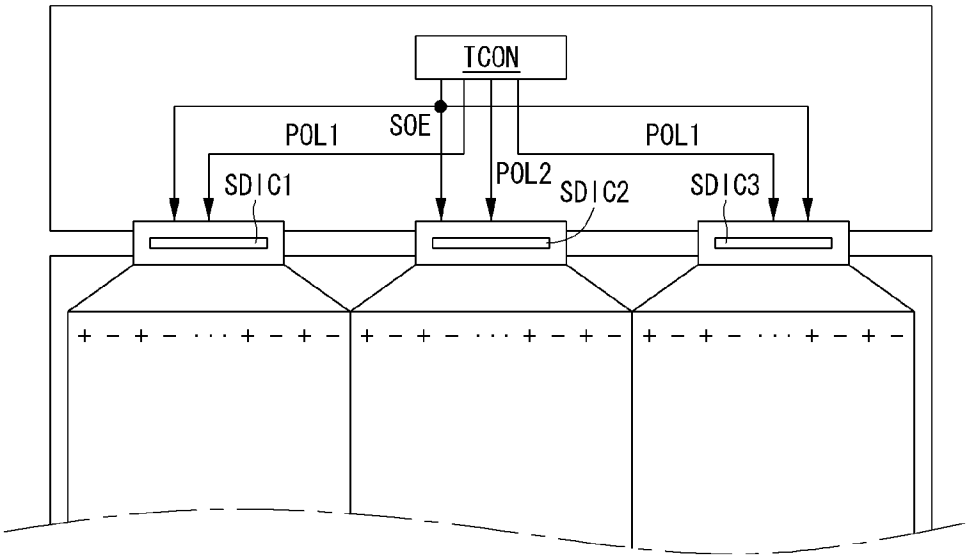
FIG. 8 is a view illustrating horizontal 1-dot inversion in a liquid crystal display according to an exemplary embodiment of the present invention.
Figure 9:
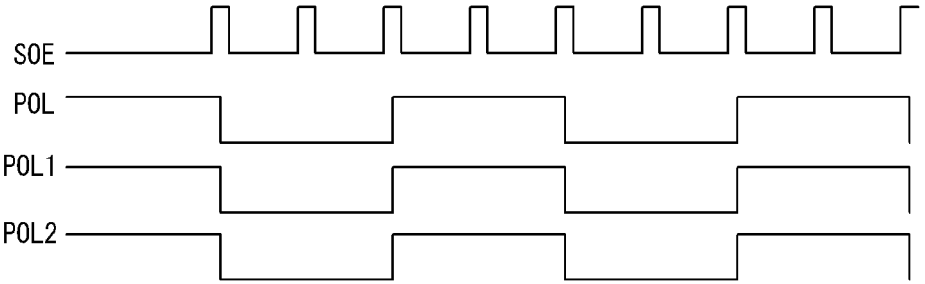
FIG. 9 is a waveform diagram showing polarity control signals for controlling horizontal 1-dot inversion of the liquid crystal display according to the exemplary embodiment of the present invention.
Figure 10:
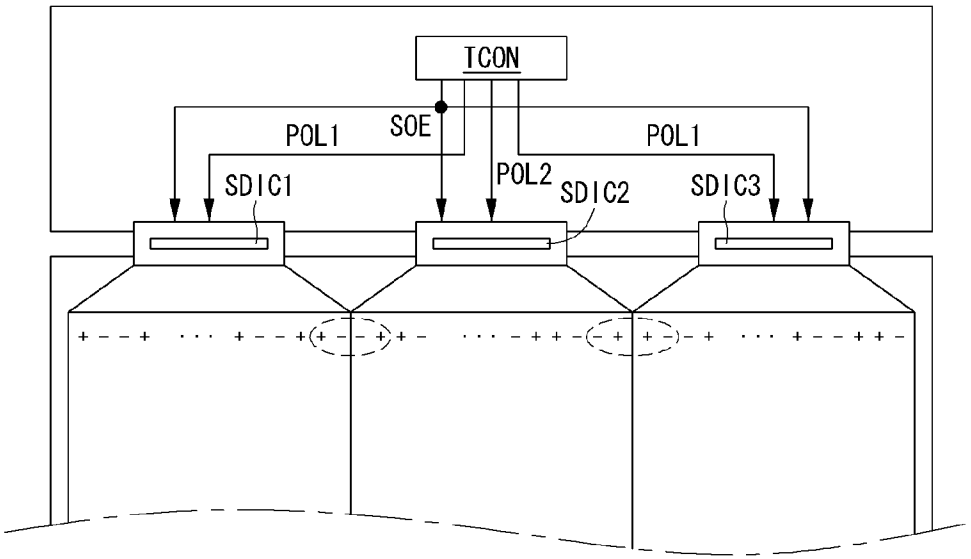
FIG. 10 is a view illustrating horizontal 2-dot inversion in a liquid crystal display according to an exemplary embodiment of the present invention.
Figure 11:
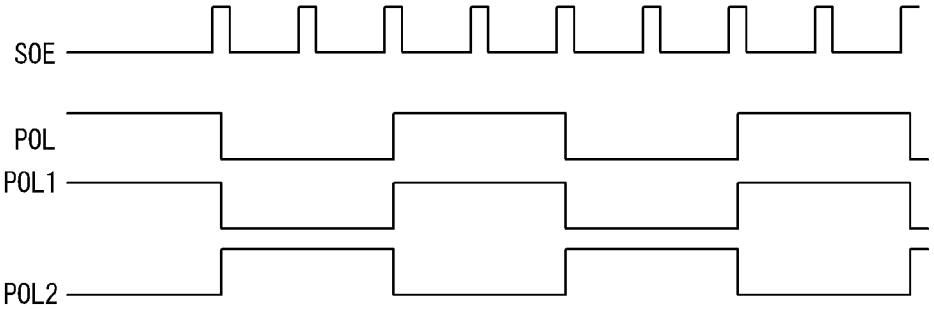
FIG. 11 is a waveform diagram showing polarity control signals for controlling horizontal 2-dot inversion of the liquid crystal display according to the exemplary embodiment of the present invention.

The polarity control signal generator 74 generates a reference polarity control signal POL as shown in FIGS. 9 and 11. The polarity control signal conversion logic circuit 75 generates a horizontal polarity control signal HINV at a high logic level in response to a control signal from the image analyzer 73 upon receipt of weak pattern data to drive the source drive ICs SDIC1 to SDIC3 by the horizontal 2-dot inversion and generate first and second polarity control signals POL1 and POL2 in opposite phases. On the other hand, the polarity control signal conversion logic circuit 75 generates a horizontal polarity control signal HINV at a low logic level in response to a control signal from the image analyzer 73 upon receipt of normal pattern data other than weak pattern data to drive the source drive ICs SDIC1 to SDIC3 by the horizontal 1-dot inversion and generate first and second polarity control signals POL1 and POL2 in the same phase. The first polarity control signal POL1 is input into the odd-numbered source drive ICs SDIC1 and SDIC3, and the second polarity control signal POL2 is input into the even-numbered source drive ICs SDIC2. If the polarity of the data voltages output simultaneously from the source drive ICs SDIC1 to SDIC3 is inverted by the horizontal 1-dot inversion as shown in FIG. 8, the polarity control signal conversion logic circuit 75 generates the first and second polarity control signals POL1 and POL2 in the same phase as the reference polarity control signal POL as shown in FIG. 9. If the polarity of the data voltages output simultaneously from the source drive ICs SDIC1 to SDIC3 is inverted by the horizontal 2-dot inversion as shown in FIG. 10, the polarity control signal conversion logic circuit 75 generates the first polarity control signal POL1 in the same phase as the reference polarity control signal POL but generates the second polarity control signal POL2 in the opposite phase of that of the reference polarity control signal POL as shown in FIG. 11.

Meanwhile, as explained in Korean Patent Application No. 10-2008-0032638 filed on Apr. 8, 2008, the polarity control signal conversion logic circuit 75 is able to invert a logic value of the horizontal polarity control signal HINV according to the type of a weak pattern of the input image detected by the image analyzer 73 and control the source drive ICs SDIC1 to SDIC3 according to the type of the weak pattern by the horizontal 1-dot inversion or by the horizontal 2-dot inversion.

FIG. 8 is a view illustrating horizontal 1-dot inversion in a liquid crystal display according to an exemplary embodiment of the present invention. FIG. 9 is a waveform diagram showing polarity control signals for controlling horizontal 1-dot inversion of the liquid crystal display according to the exemplary embodiment of the present invention.

Referring to FIGS. 8 and 9, a horizontal polarity control signal HINV:L of a low logic voltage is input into the option terminals H_2DOT of the source drive ICs SDIC1 to SDIC3. Accordingly, the source drive ICs SDIC1 to SDIC3 simultaneously output data voltages whose polarity is inverted by the horizontal 1-dot inversion, that is, for each dot.

The timing controller TCON inputs the first polarity control signal POL1 into the odd-numbered source drive ICs SDIC1 and SDIC3 and the second polarity control signal POL2 into the even-numbered source drive ICs SDIC2. The first and second polarity control signals POL1 and POL2 are generated in the same phase. Therefore, if the first logic values of the first and second polarity control signals POL1 and POL2 are high, the source drive ICs SDIC1 to SDIC3 output the odd-numbered data voltages of the first horizontal display line LINE#1 as positive data voltages (+) and the even-numbered voltages of the first line LINE#1 as negative data voltages (−). In the next frame period, if the first logic value of the polarity control signal POL is inverted to low, the source drive ICs SDIC1 to SDIC3 output the odd-numbered data voltages of the first horizontal display line LINE#1 as negative data voltages (−) and the even-numbered data voltages of the first horizontal display line LINE#1 as positive data voltages (+).

FIG. 10 is a view illustrating horizontal 2-dot inversion in a liquid crystal display according to an exemplary embodiment of the present invention. FIG. 11 is a waveform diagram showing polarity control signals for controlling horizontal 2-dot inversion of the liquid crystal display according to the exemplary embodiment of the present invention.

Referring to FIGS. 10 and 11, a horizontal polarity control signal HINV:H of a high logic voltage is input into the option terminals H_2DOT of the source drive ICs SDIC1 to SDIC3. Accordingly, the source drive ICs SDIC1 to SDIC3 simultaneously output data voltages whose polarity is inverted by the horizontal 2-dot inversion, that is, every 2 dots.

The timing controller TCON inputs the first polarity control signal POL1 into the odd-numbered source drive ICs SDIC1 and SDIC3 and the second polarity control signal POL2 into the even-numbered source drive ICs SDIC2. The first and second polarity control signals POL1 and POL2 are generated in the opposite phase to each other.

Therefore, if the first logic value of the first polarity control signal POL1 is high and the first logic value of the second polarity control signal POL2 is low, the odd-numbered source drive ICs SDIC1 and SDIC3 output the odd-numbered data voltages of the first horizontal display line LINE#1 as positive data voltages (+) and the even-numbered voltages of the first horizontal display line LINE#1 as negative data voltages (−). At the same time, the even-numbered source drive ICs SDIC2 output the odd-numbered data voltages of the first horizontal display line LINE#1 as negative data voltages (−) and the even-numbered voltages of the first horizontal display line LINE#1 as positive data voltages (+).

In the next frame period, if the first logic value of the first polarity control signal POL1 is inverted to low and the first logic value of the second polarity control signal POL2 is inverted to high, the odd-numbered source drive ICs SDIC1 and SDIC3 output the odd-numbered data voltages of the first horizontal display line LINE#1 as negative data voltages (−) and the even-numbered data voltages of the first horizontal display line LINE#1 as positive data voltages (+). At the same time, the even-numbered source drive ICs SDIC2 output the odd-numbered data voltages of the first horizontal display line LINE#1 as positive data voltages (+) and the even-numbered voltages of the first horizontal display line LINE#1 as negative data voltages (−)

Figure 2:
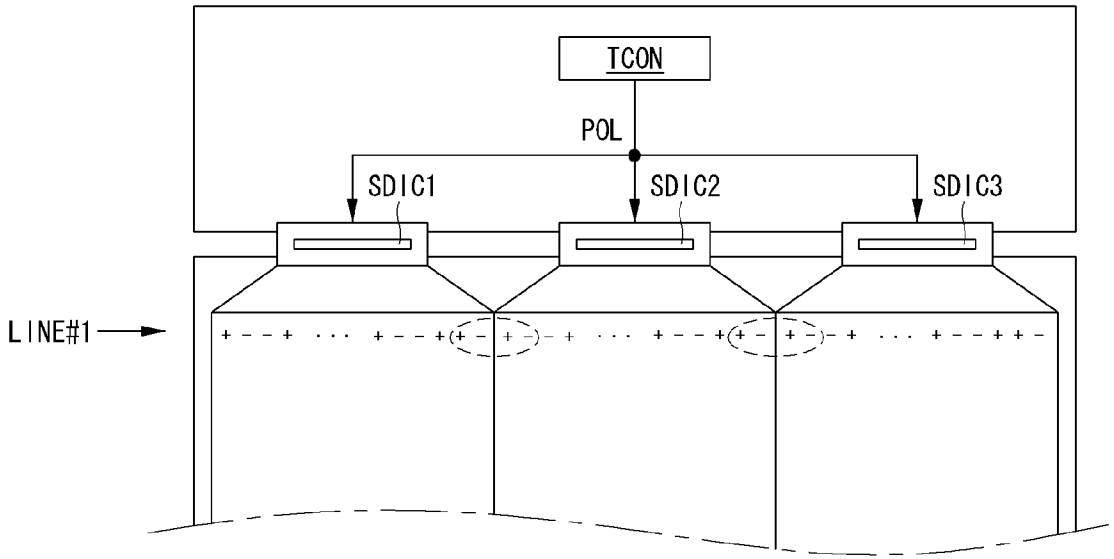
FIG. 2 (RELATED ART)
FIG. 2 is a view illustrating horizontal 2-dot inversion in a conventional liquid crystal display.

The polarity control signals are respectively input into the source drive ICs SDIC1 to SDIC3, and when the source drive ICs SDIC1 to SDIC3 are driven by the horizontal 1-dot inversion or by the horizontal 2-dot inversion, the phases of the polarity control signals are adaptively inverted depending on a selected inversion driving scheme. As a result, even in the case that the remainder left after dividing the number of output channels of the source drive IC by 4 is not zero and the source drive ICs SDIC1 to SDIC3 are driven by the horizontal 2-dot inversion, the horizontal polarity inversion cycle is not changed at the boundaries between the source drive ICs as indicated by dotted lines in FIG. 2, but the polarity of a data voltage is inverted by the horizontal 2-dot inversion.

Figure 12:
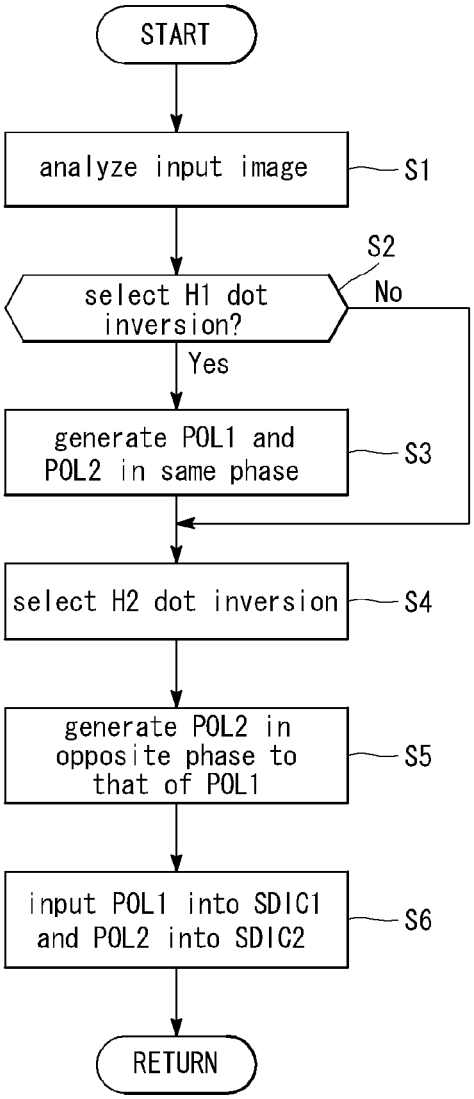
FIG. 12 is a flowchart showing a method of controlling dot inversion of a liquid crystal display according to the exemplary embodiment of the present invention step by step.

FIG. 12 is a flowchart showing a method of controlling dot inversion of a liquid crystal display according to the exemplary embodiment of the present invention step by step.

Referring to FIG. 12, an input image is analyzed to detect a weak pattern in which a white gray scale and a black gray scale are regularly repeated (S1). Then, it is determined whether the liquid crystal display is to be driven by horizontal 1-dot inversion or by horizontal 2-dot inversion depending on whether weak pattern data is input or not (S2 and S4).

If the liquid crystal display is driven by the horizontal 1-dot inversion, a horizontal polarity control signal HINV is generated at a low logic level, the source drive ICs SDIC1 to SDIC3 are respectively driven by the horizontal 1-dot inversion. Then, when the source drive ICs SDIC1 to SDIC3 are driven by the horizontal 1-dot inversion, a first polarity control signal POL1 and a second polarity control signal POL2 are generated in the same phase (S3).

If the liquid crystal display is driven by the horizontal 2-dot inversion, a horizontal polarity control signal HINV is generated at a high logic level, the source drive ICs SDIC1 to SDIC3 are respectively driven by the horizontal 2-dot inversion. Then, when the source drive ICs SDIC1 to SDIC3 are driven by the horizontal 2-dot inversion, a first polarity control signal POL1 is generated in the opposite phase to that of a second polarity control signal POL2 (S5).

Next, the first polarity control signal POL1 is input into the odd-numbered source drive ICs SDIC1 and SDIC3, and the second polarity control signal POL2 is input into the even-numbered source drive ICs SDIC2 to control the polarity of data voltages output from the source drive ICs SDIC1 to SDIC3 (S6).

The present inventors confirmed the effect of the present invention by a test. In this test, a liquid crystal display having such a pixel array as shown in FIG. 5 is used as a test sample to switch the source drive ICs SDIC1 to SDIC3 by the horizontal 1-dot inversion or by the horizontal 2-dot inversion according to the presence or absence of a weak pattern of an input image and to switch the phases of the first and second polarity control signals POL1 and POL2 to the same phase and to the opposite phase to each other. As a result of this test, in the case of an input image of a normal pattern having no weak pattern, no picture quality degradation was observed from the display image when the source drive ICs SDIC1 to SDIC3 are driven by the horizontal 1-dot inversion and the first and second polarity control signals POL1 and POL2 are generated in the same phase. Also, in the case of an input image having a weak pattern, no picture quality degradation was observed from the display image when the source drive ICs SDIC1 to SDIC3 are driven by the horizontal 2-dot inversion and the first and second polarity control signals POL1 and POL2 are generated in the opposite phase to each other.

As described above, the present invention controls the polarity of a data voltage of a liquid crystal display panel by independently inputting respective polarity control signals to the source drive ICs. As a result, the present invention can adaptively switch between horizontal 1-dot inversion and horizontal 2-dot inversion according to the type of a weak pattern of an input image or can eliminate any point where the horizontal 2-dot inversion is not continuous from the boundaries between the source drive ICs when the liquid crystal display is driven after correcting the input image by FRC, thereby further increasing the effect of display quality improvement.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A liquid crystal display comprising:

a liquid crystal display panel including a plurality of data lines and a plurality of gate lines crossing each other;

a first source drive IC for outputting a data voltage to the data lines and inverting the polarity of the data voltage in response to a first polarity control signal;

a second source drive IC for outputting the data voltage to the data lines and inverting the polarity of the data voltage in response to a second polarity control signal; and a timing controller for generating the first and second polarity control signals in the same phase when the source drive ICs output data voltages whose polarity is inverted by horizontal 1-dot inversion and generating the first and second polarity control signals in the opposite phase to each other when the source drive ICs output data voltages whose polarity is inverted by horizontal 2-dot inversion regardless of whether a remainder of dividing a total number of output channels of each of the source drive ICs by four is zero, wherein the timing controller comprises:

an image analyzer for analyzing the input image to detect weak pattern data in which white gray scale data and black gray scale data are regularly repeated; and a polarity control signal conversion logic circuit for generating a horizontal polarity control signal to select either the horizontal 1-dot inversion or the horizontal 2-dot inversion and outputting the first and second polarity control signals, wherein the polarity control signal conversion logic circuit inverts the horizontal polarity control signal and the second polarity control signal when the weak pattern data is detected by the image analyzer, wherein a frame frequency of the liquid crystal display is 60×i Hz (i is a positive integer of 2 or greater).

2. The liquid crystal display of claim 1, wherein the timing controller comprises an FRC processor for adding an FRC correction value to data of an input image and supplying the data to the source drive ICs.

3. The liquid crystal display of claim 1, wherein each of the source drive ICs comprises an option terminal into which the horizontal polarity control signal is input, and outputs the data voltage whose polarity is inverted by the horizontal 1-dot inversion in response to a first logic value of the horizontal control signal and outputs the data voltage whose polarity is inverted by the horizontal 2-dot inversion in response to a second logic value of the horizontal polarity control signal.

4. A method of controlling dot inversion of a liquid crystal display comprising a liquid crystal display panel including a plurality of data lines and a plurality of gate lines crossing each other and first and second source drive ICs for inverting the polarity of a data voltage supplied to the data lines in response to respective polarity control signals, the method comprising:

generating the first and second polarity control signals in the same phase when the source drive ICs output data voltages whose polarity is inverted by horizontal 1-dot inversion;

generating the first and second polarity control signals in the opposite phase to each other when the source drive ICs output data voltages whose polarity is inverted by horizontal 2-dot inversion regardless of whether a remainder of dividing a total number of output channels of each of the source drive ICs by four is zero;

analyzing the input image to detect weak pattern data in which white gray scale data and black gray scale data are regularly repeated;

generating a horizontal polarity control signal to select either the horizontal 1-dot inversion or the horizontal 2-dot inversion and outputting the first and second polarity control signals;

inverting the horizontal polarity control signal and the second polarity control signal when the weak pattern data is detected; and inputting the first polarity control signal and the horizontal polarity control signal into the first source drive IC, and the second polarity control signal and the horizontal polarity control signal into the second source drive IC, wherein a frame frequency of the liquid crystal display is 60×i Hz (i is a positive integer of 2 or greater).

5. The method of claim 4, further comprising: adding an FRC correction value to data of an input image and supplying the data to the source drive ICs.

* * * * *